US006132027A

United States Patent [19]

Suzuki et al.

[11] Patent Number: 6,132,027

[45] Date of Patent: Oct. 17, 2000

[54] INK-JET TYPE IMAGE FORMING APPARATUS

[75] Inventors: Takashi Suzuki; Tatsuhiro Ishize; Takaaki Sekiyama, all of Ebina, Japan

[73] Assignee: Fuji Xerox Co., Ltd., Tokyo, Japan

[21] Appl. No.: 08/900,132

[22] Filed: Jul. 25, 1997

[30] Foreign Application Priority Data

Jul. 30, 1996 [JP] Japan ..... 8-200361

[51] Int. Cl.[7] ..... B41J 2/165

[52] U.S. Cl. ..... 347/33; 347/29

[58] Field of Search ..... 347/33, 29, 32

[56] References Cited

U.S. PATENT DOCUMENTS

| | | | |
|---|---|---|---|
| 5,103,244 | 4/1992 | Gast et al. | 347/33 |
| 5,115,250 | 5/1992 | Harmon et al. | 347/33 |
| 5,164,748 | 11/1992 | Katayanagi et al. | 347/30 |
| 5,539,435 | 7/1996 | Uchida et al. | 347/33 |
| 5,543,826 | 8/1996 | Kuronuma et al. | 347/23 |
| 5,619,232 | 4/1997 | Maeno | 347/30 |
| 5,730,538 | 3/1998 | Kato | 400/702.1 |

FOREIGN PATENT DOCUMENTS

| | | | |
|---|---|---|---|
| 3-71267 | 11/1991 | Japan . | |
| 6-262768 | 9/1994 | Japan | 347/32 |
| 7-31980 | 5/1995 | Japan . | |
| 7-55562 | 6/1995 | Japan . | |

*Primary Examiner*—N. Le
*Assistant Examiner*—Shih-Wen Hsieh
*Attorney, Agent, or Firm*—Oliff & Berridge, PLC

[57] ABSTRACT

A simplified, reduced-size ink-jet type image forming apparatus includes a cap member that covers a nozzle, a pump member that sucks air from inside the cap member, a cap through-hole seal member that seals the through-hole of the cap member, a wiper member that removes the ink adhered to an edge of the nozzle and a carriage position fixing member to which is affixed a recording head transfer carriage, that is moved by a drive motor.

16 Claims, 21 Drawing Sheets

INK-JET TYPE IMAGE FORMING APPARATUS

BACKGROUND OF THE INVENTION

1. Field of Invention

This invention relates to an image forming apparatus, and relates specifically to an ink-jet type image forming apparatus in which an image is formed by ejecting ink onto a recording medium such as paper.

2. Description of Related Art

Conventionally, an ink-jet type image forming apparatus has, for example, a recording medium transfer member that transfers paper and the like in a specified transfer direction and a recording head carriage arranged opposite a transfer path of the recording medium. The carriage is movable in a direction perpendicular to the transfer direction of the recording medium and ejects ink from the nozzles towards the transfer path of the recording medium.

Moreover, a full-color, ink-jet type image apparatus uses a recording head carriage capable of ejecting yellow ink, magenta ink, cyan ink and black ink. Further, the full-color, ink-jet type image apparatus generally comprises a plurality of nozzle components for each respective color and a plurality of ink tanks that supply ink to the nozzle components. Moreover, each of the nozzle components has a plurality of nozzles formed therein and each of the ink tanks is designed to be attachable to and detachable from the recording head carriage.

The ink-jet type image forming apparatus carries the recording medium using the recording medium transfer member. A prescribed image is formed on the recording medium by ejecting ink in accordance with image information while the recording medium is being transferred and the recording head carriage is being moved back-and-forth across the transfer path.

However, this type of ink-jet type image forming apparatus has various problems in maintaining image quality. Poor image quality is associated with the ink itself as well as its ejection from the nozzles to form the image.

Specifically, in the aforementioned ink-jet type image forming apparatus, first, the ink dries out in the nozzle components particularly when no images are being formed. When this condition occurs, the viscosity of the ink increases and, thus, the way the ink ejects from the nozzle components changes so that the desired image is not easily formed.

Second, in the aforementioned ink-jet type image forming apparatus, when foreign material or air enters the nozzles, the ink does not eject properly. Also, when the drying of the ink has progressed, the ink does not eject properly.

Third, in the aforementioned ink-jet type image forming apparatus, there are cases when the ink adheres to the tips of the nozzles specifically around the aperture edge of the nozzle. This occurs because the ink leaks from the nozzles due to a change of environmental conditions. When this condition occurs, the way the ink is ejected changes, and the desired image cannot be easily formed.

In the conventional ink-jet type image forming apparatus described above, these problems have been solved by providing a cap member that protects against the ink from drying out by covering the nozzle when images are not being formed. Also, a pump member is provided that sucks foreign material from the nozzle and a wiper member is provided that removes ink which adheres to the tip of the nozzle.

Moreover, in the aforementioned ink-jet type image forming apparatus, in order to solve these problems without obstructing the back-and-forth motion of the recording head carriage, it is necessary for the cap member to be capable of moving from a position in which the back-and-forth motion is not obstructed to a position in which the nozzles are covered, and to determine these positions. It is also necessary that the position of the pump member can be determined as it is moved from a position in which the back-and-forth motion is not obstructed to a position in which the pump member is connected to the nozzle. It is further necessary to perform the pumping operation when the pump member is connected to the nozzle. It is also necessary that the wiper member be capable of moving from a position in which the back-and-forth motion is not obstructed to a position where it contacts the nozzles. Also, it is necessary to be able to determine these positions of the wiper member.

However, it is difficult to reduce the size of such an apparatus since it is necessary to install each of these maintenance components.

Moreover, in the conventional ink-jet type image forming apparatuses, there are maintenance components that have a reduced size and are designed such that the cap member is connected to the pump and has a combined use for pumping. However, miniaturizing these maintenance components is difficult.

SUMMARY OF THE INVENTION

Therefore, an object of the present invention is to solve the various problems described above in conjunction with providing an ink-jet type image forming apparatus in which it is possible to reduce its size.

In short, the present invention is an ink-jet type image forming apparatus, comprising a recording medium transfer member for transferring a recording medium in a specified transfer direction defining a transfer path, and a recording head carriage that is disposed opposite the transfer path of the recording medium. The recording head carriage is movable in a recording direction perpendicular to the transfer direction of the recording medium, and ejects ink from a nozzle member towards the transfer path of the recording medium while the recording medium is being transferred by the recording medium transfer member and the recording head carriage is being operated in a back-and-forth motion in the recording direction. This forms images on the recording medium by ejecting ink corresponding to image information. The ink-jet type image forming apparatus is provided with a cap member that is arranged so as to be movable while facing a path of motion of the nozzle member and to be able to cover the nozzle member. The cap has through-holes formed therein that communicate with the outside air when the cap is in the covering state. A pump is provided that evacuates the interior of the cap member and a cap through-hole sealing member is provided that is movable with respect to the through-holes and that can seal the through-holes. A wiper member is provided so as to be movable while facing the path of motion of the nozzle member and to remove ink that is adhered to the tip of the nozzle. A carriage position fixing member is provided opposite the path of motion of the recording head carriage and fixes the position of the carriage. Drive means is provided that moves the cap member, the cap through-hole sealing member, the wiper member and carriage position fixing member. The drive means also drives the pump.

In this invention, the nozzle member ejects the ink and generally has a plurality of nozzles. Moreover, it is also acceptable so that the plurality of nozzles eject one type or color of ink, or eject separate colors of ink for each group of nozzles.

The cap member should be arranged so as to be movable opposite the path of motion of the nozzle member and for the cap member to cover the nozzle, with through-holes that communicate with the outside air in a covered state. For example, a concave portion may be formed in a front surface opposite the nozzle, and may comprise a rubber cap in which through-holes that extend through the concave portion to the side surface are formed, an ink holding main body such as a sponge arranged within the concave portion, and a cap case in which the cap is accommodated. The cap case is arranged so as to be movable in a direction in which it contacts with and separates from the nozzle.

Moreover, the covering operation does not refer only to the state in which the perimeter of the nozzle is completely covered by the cap member, but also includes the state in which it is covered to the extent in which it is possible to suitably prevent the drying out of the ink within the interior of the nozzle.

Further, in the ink-jet type image forming apparatus of the type that has a plurality of nozzles, it is acceptable to cover each nozzle with a corresponding cap member or to cover the plurality of nozzles with one cap member.

Moreover, when the nozzle is completely closed to the outside environment by the cap member as the cap member covers the nozzle and when the atmospheric pressure is raised or lowered with respect to the covered nozzle, a pressure difference occurs between ambient pressure and the pressure in the ink tank. The result is that the ink is drawn back within the interior of the nozzle and the ink leaks within the interior of the cap. Therefore, the through-hole is provided to prevent this occurrence.

In the ink-jet type image forming apparatus described above, the cap member is maintained on a carriage which is movable with respect to the recording head carriage transfer path. The cap carriage is arranged opposite the recording head carriage and is also movable in the same direction as the direction of movement of the recording head carriage. Meshing members are provided on each of the cap carriage and the recording head carriage. First, the cap carriage is transferred to a position at which the meshing members can mesh. Then, the recording head carriage is transferred until the meshed members are meshed with each other, and the cap carriage is transferred in the same direction as the recording direction of the recording head carriage to a specified position. Finally, the nozzle should be covered by transferring the cap carriage until the cap member covers the nozzle. By so doing, the cap member can be accurately positioned with respect to the nozzle member and can cover the nozzle member without performing a feed back control based on detecting the position of the nozzle or the cap member or, in short, without performing a complicated control.

The cap through-hole seal member is arranged so as to be movable with respect to the through-hole and seals the through-hole. For example, there is a sealing valve that is arranged to seal the through-hole when the cap carriage moves with the recording head carriage in the same direction as the direction of motion of the recording head carriage. Thus, it is possible to make the structure of the drive means simple since the sealing valve does not need to be moved by the drive means.

The pump member is connected to the cap member and capable of evacuating the inside of the cap member. For example, the structure may comprise a pump that generates negative pressure and a hose that connects the pump and the cap member.

With this structure, it is possible to withdraw solidified ink from the nozzle if the pump is driven while the through-hole is sealed by the sealing valve. Moreover, it is possible to withdraw "waste" ink when the recording head carriage performs a "test firing" if the pump is operated under a condition in which the cap member is separated from the nozzle. Hereafter, the test firing is called a dummy jet.

The wiper member is arranged so as to be movable opposite the path of motion of the nozzle and is able to remove ink which is adhered to an edge of the nozzle. For example, a rubber blade is arranged so as to be able to contact and separate from the path of motion of the nozzle. If the rubber blade contacts the edge of the nozzle, the ink that is adhered to the edge of the nozzle can be removed without moving the rubber blade itself but by moving the recording head carriage. This makes the structure of the drive means simple. Moreover, it is preferable to arrange an absorptive main body, for example, a sponge, to absorb the ink between each nozzle member in the case of a recording head carriage that has several nozzle members. This prevents mixing of ink colors by the rubber blade.

The carriage positioning fixing member is arranged opposite the path of motion of the recording head carriage, and fixes the carriage. For example, the structure may comprise a concave part formed in the recording head carriage and a fixing pin arranged so as to be able to proceed towards and retreat from the concave part.

It is preferable for the drive means to move the cap member, the cap through-hole sealing member, the wiper member and the carriage position fixed member, and to drive the pump member. For example, the drive means may comprise a pulse motor capable of forward and reverse rotation and a cam drive transferring member that transfers the rotation of the pulse motor to each member. In this example, it is preferable to stop the pulse motor at a specified rotating position at a selected positioning time, and to continuously rotate the pulse motor in the forward and reverse directions in the range of the specified rotating angle while driving the pump.

Further, in the ink-jet type image forming apparatus of this invention, the positions of the cap member, the wiper member, the carriage positioning fixing member and the cap through-hole sealing member are determined by the driving means as it moves these components in the advancing and retreating directions opposite the path of motion of the recording head carriage. It is possible to execute various maintenance operations through the drive means.

Moreover, in the ink-jet type image forming apparatus, it is not necessary to install the drive means separately to each member, especially to the pump member and the other members, since the driving means determines the position of each member and also drives the pump.

DETAILED DESCRIPTION OF PREFERRED EMBODIMENTS

Hereafter, a detailed description of embodiments of the image forming apparatus of this invention is provided, based on the attached drawings.

Figure 1:
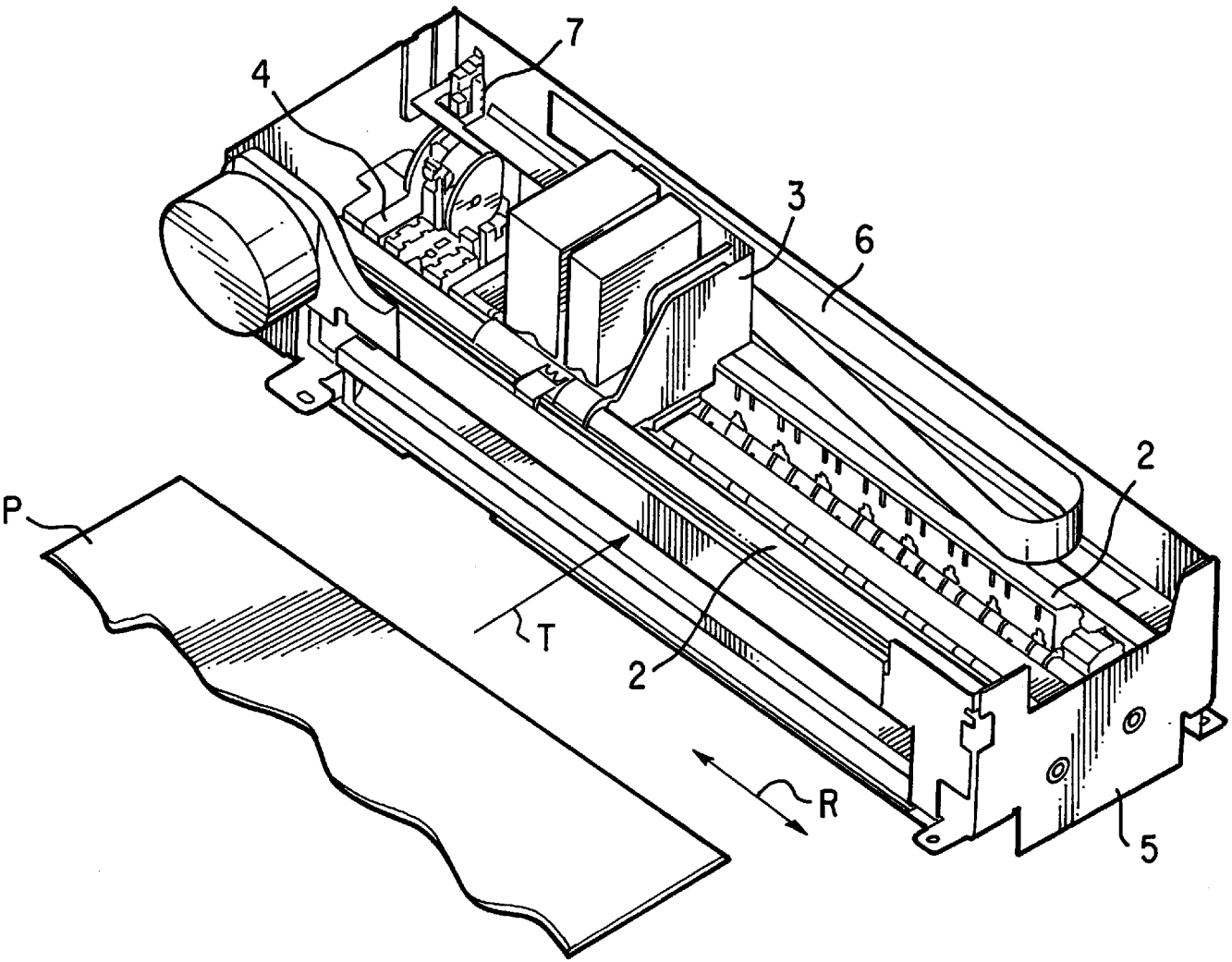
FIG. 1 is a perspective view of the ink-jet type image forming apparatus of a preferred embodiment of the present invention.
Figure 3:
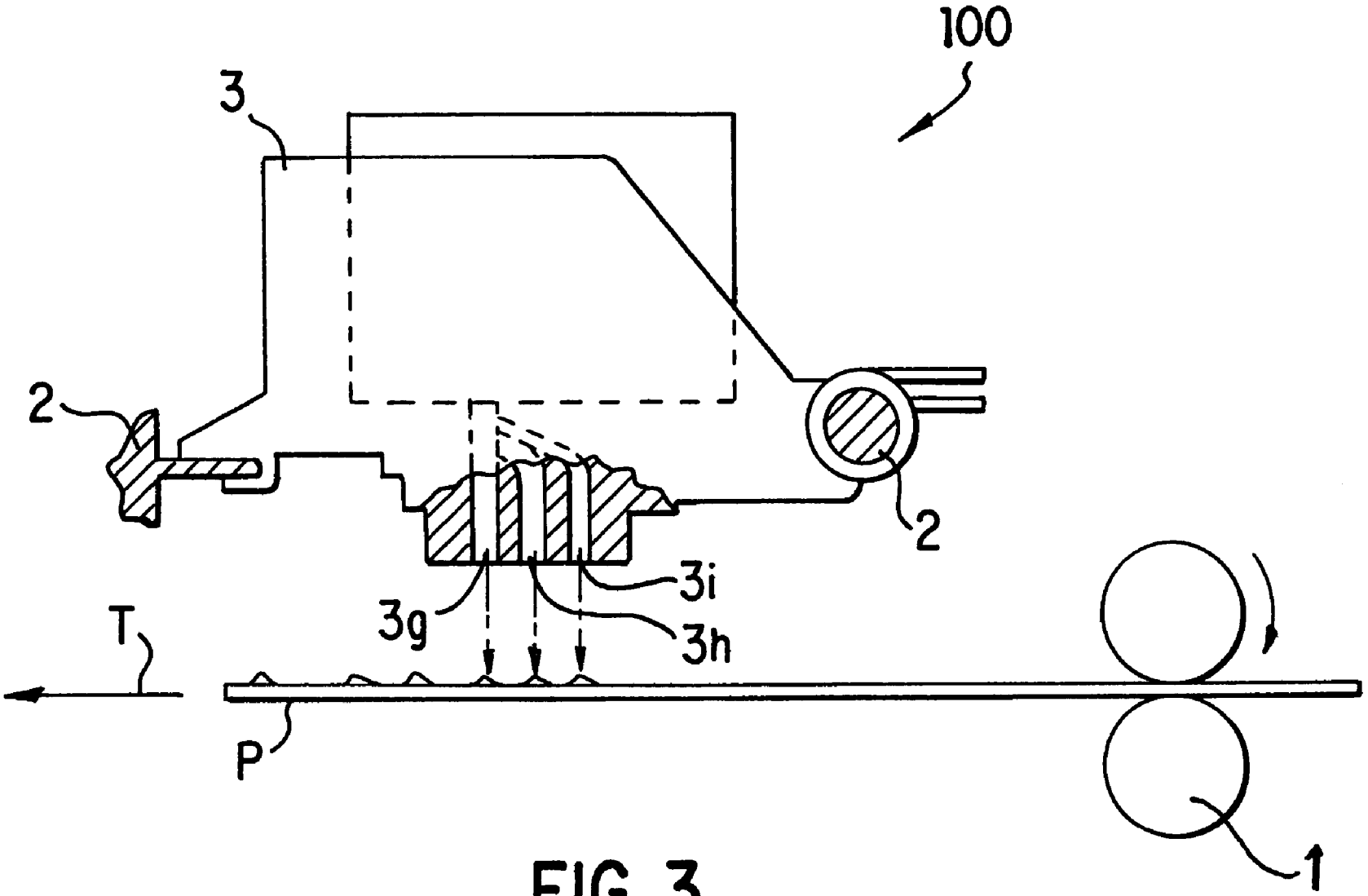
FIG. 3 is a side view of the image forming apparatus of FIG. 1 illustrating movement of a recording medium.

An ink-jet type image forming apparatus 100 relating to a preferred embodiment is shown in FIGS. 1 and 3.

The image forming apparatus 100 has a recording medium transfer member 1 that transfers a recording medium P in a specified direction, a pair of guide members 2 opposite a transfer path T of the record medium P and extending in direction R perpendicular to a transfer direction of the recording medium P, a recording head carriage 3 that is supported by the guide members 2, a maintenance station 4 that is arranged under the guide members 2 and close to the recording medium transfer path T, and a housing that houses all of the aforementioned elements. Image information is sent to the recording head carriage 3 through a signal line 6 which is formed in a flexible base. A home position of the recording head carriage 3 is detected by a home position sensor 7 that is arranged at a position opposite the maintenance station 4.

Figure 2:
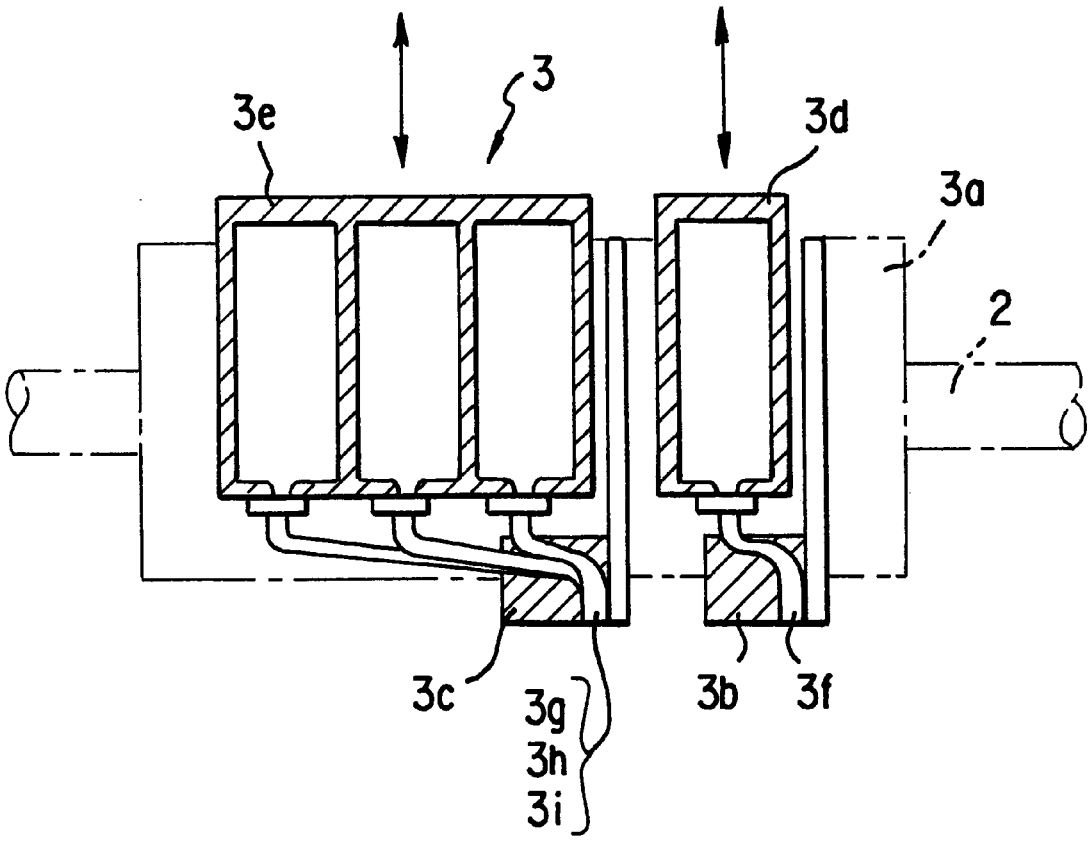
FIG. 2 is a cross-sectional view of a recording head carriage shown in FIG. 1.

As shown in FIG. 2, the recording head carriage 3 comprises a head carriage frame 3*a* arranged so as be movable on the pair of guide members 2, two nozzle members 3*b* and 3*c* that are arranged so as to spray ink lower than a bottom surface that faces the recording medium transferring path T of the head carriage frame 3*a*, and two ink tanks 3*d* and 3*e* that supply ink to each nozzle member 3*b* and 3*c*, and which are attachable to and detachable from the head carriage frame 3*a*.

Moreover, many nozzles are arranged in each nozzle member 3*b* and 3*c*. In the nozzle member 3*b*, a single color of ink is ejected in response to image information since the ink tank 3*d* which is connected to the nozzle member 3*b* supplies black ink. Meanwhile, in the other nozzle member 3*c*, three colors of ink are able to be ejected in response to the image information, since the ink tank 3*e* that is connected to the nozzle member 3*c* supplies yellow ink, magenta ink and cyan ink. In the drawings of this embodiment, several nozzles for each color described above are shown as one nozzle for convenience and, thus, 3*f* represents a group of several nozzles for black ink, 3*g* represents a group of several nozzles for yellow, 3*h* represents a group of several nozzles for magenta and 3*i* represents a group of several nozzles for cyan.

The ink-jet type image formation apparatus 100, as indicated in FIG. 3, forms the specified image on the recording medium P by transferring the recording medium P with the recording medium transfer member 1 and ejecting ink in accordance with the image information while causing the recording head carriage 3 to move with a back-and-forth motion in the direction R shown in FIG. 1.

Figure 4:
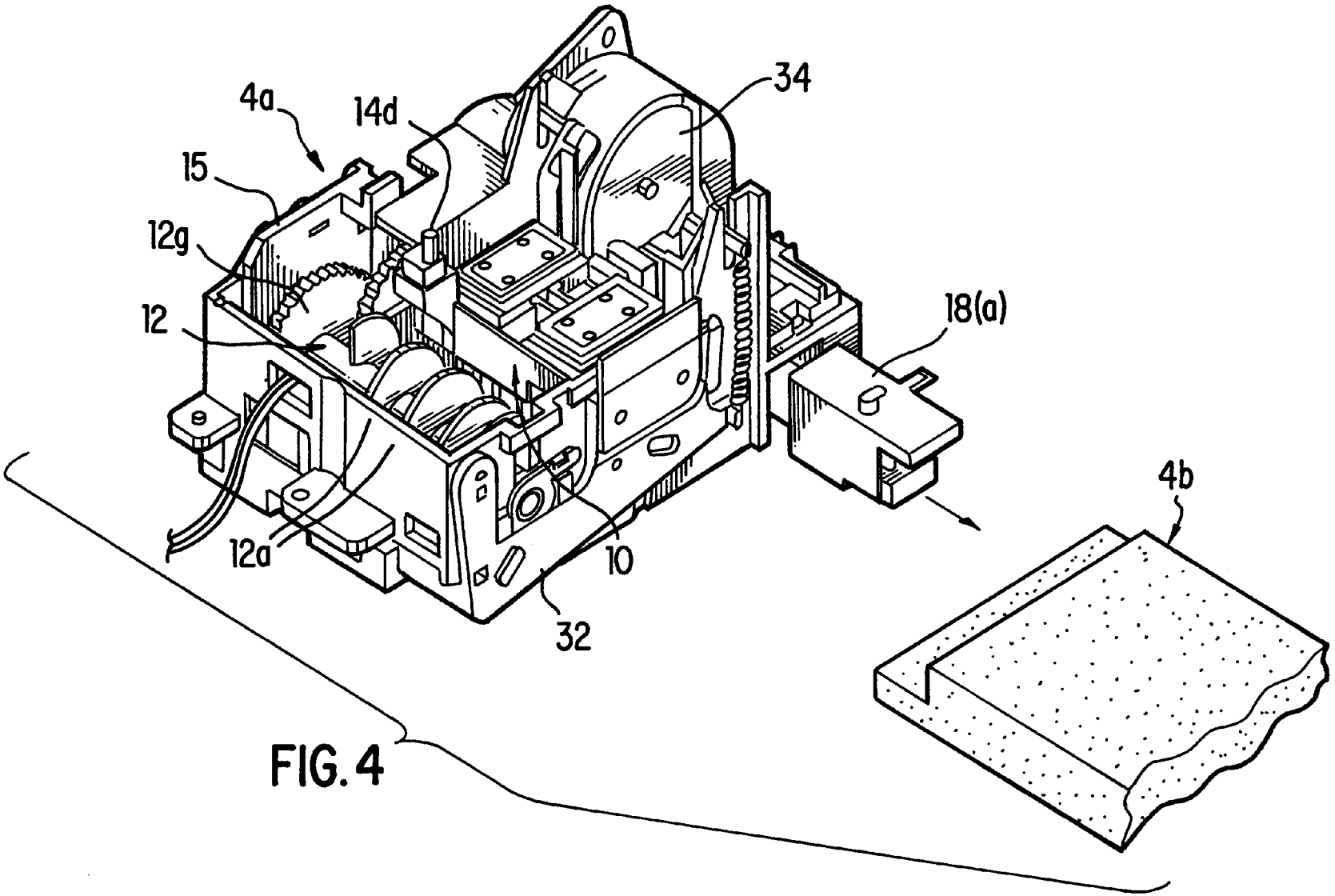
FIG. 4 is a perspective view of a maintenance station.

The maintenance station 4, as indicated in FIG. 4, comprises a station main body 4*a* and a waste ink absorbing main body 4*b* which absorbs and holds the ink discarded from the station main body 4*a*.

Figure 5:
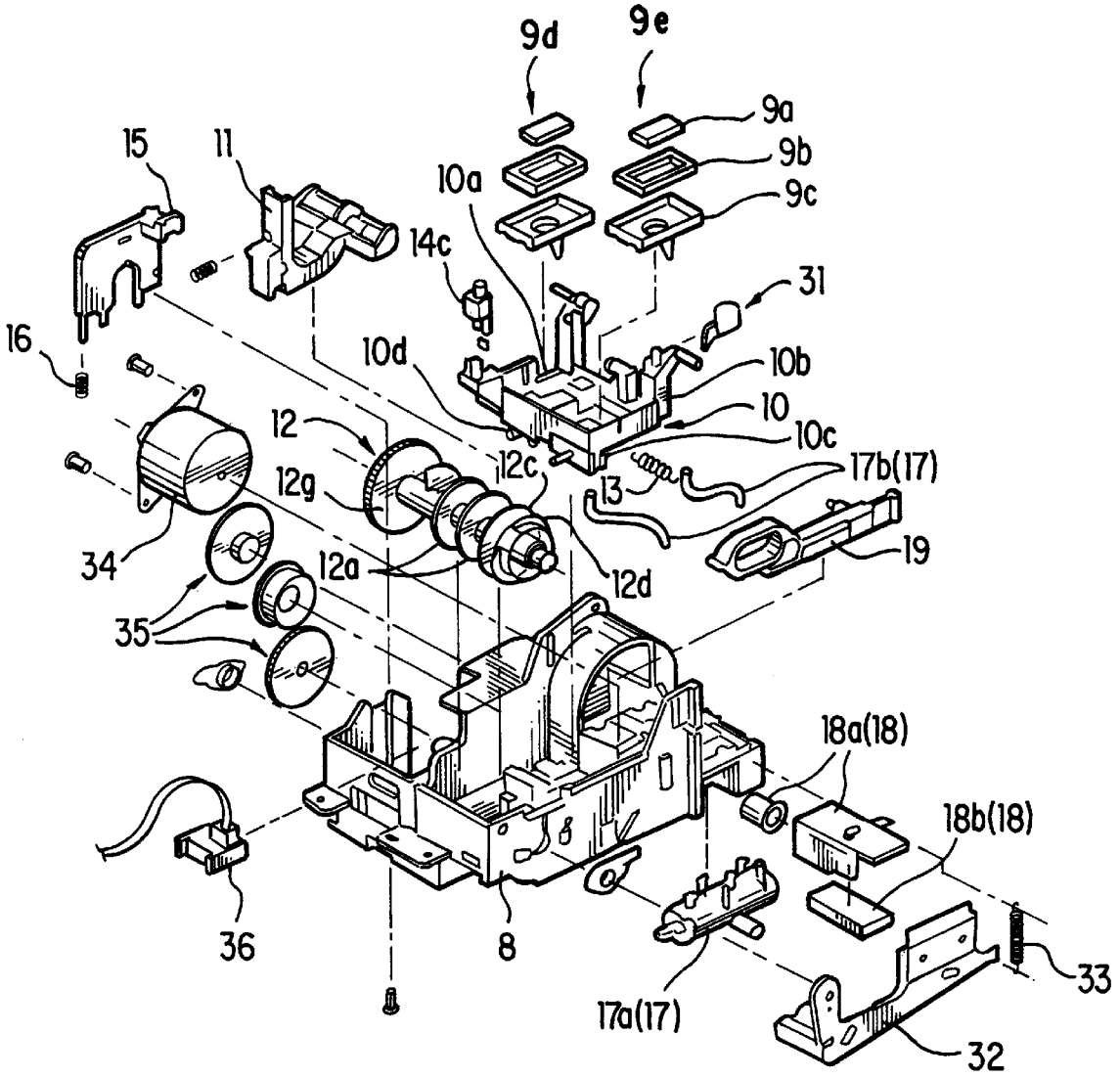
FIG. 5 is an exploded perspective view of the maintenance station of FIG. 4.

The station main body 4*a* comprises a unit housing 8 as shown in FIG. 5 and various members attached thereto.

Figure 9:
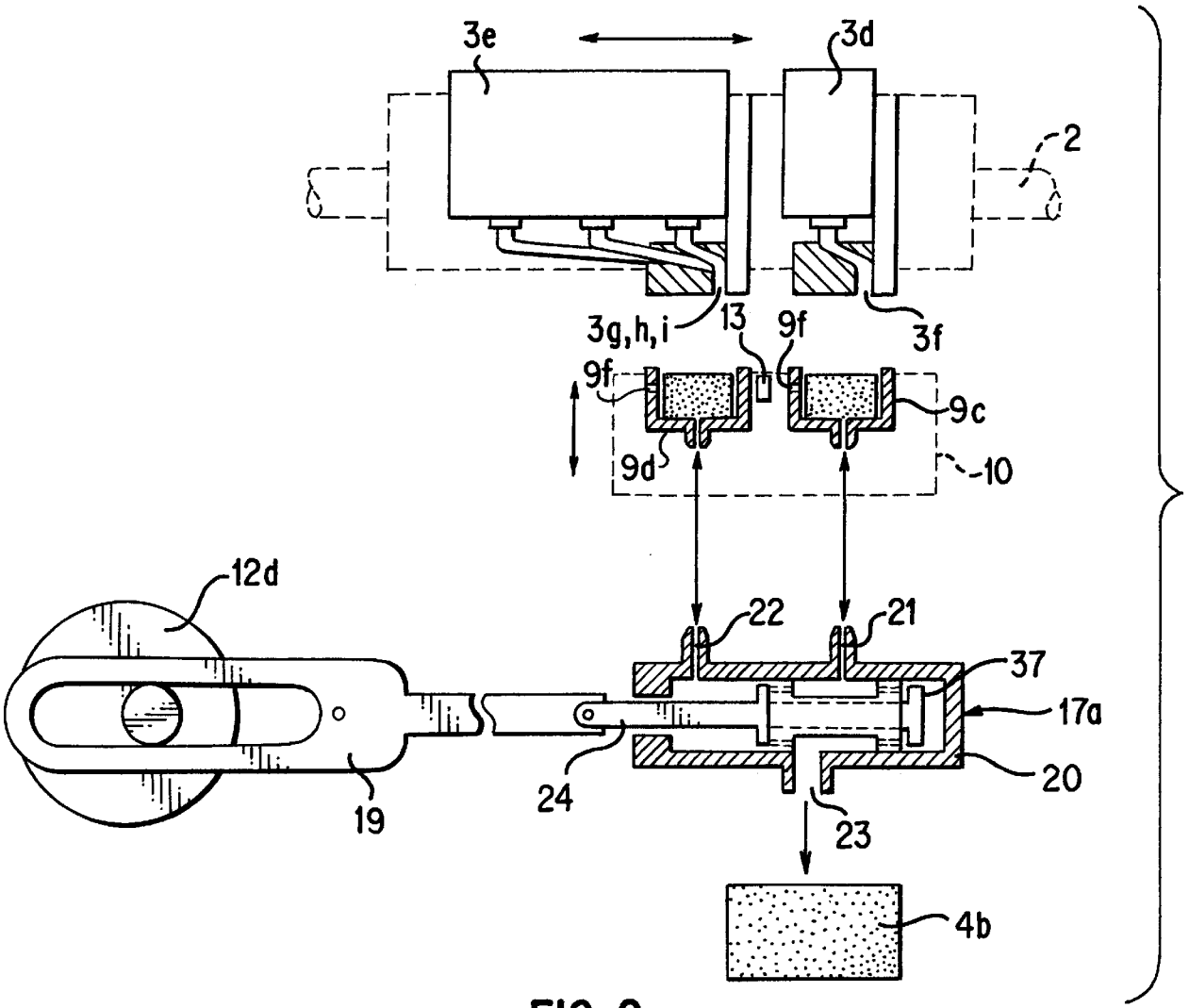
FIG. 9 is a partial cross-sectional side view of a pump member.

In FIG. 5, an ink carrier 9*a* is formed by a sponge. A rubber cap member 9*b* has a concave portion formed therein that holds the ink carrier 9*a*; and that the cap member 9*b* also has a through-hole 9*f* formed therein, shown in FIG. 9, that extends through the concave portion to a side surface of the cap member 9*b*. A cap case 9*c* holds the cap member 9*b*. Moreover, the station main body 4*a* has two cap member assemblies 9*d* and 9*e*, which are held on a cap carriage 10. Each cap member assembly includes one ink carrier 9*a*, one cap member 9*b* and one cap case 9*c*.

Figure 6:
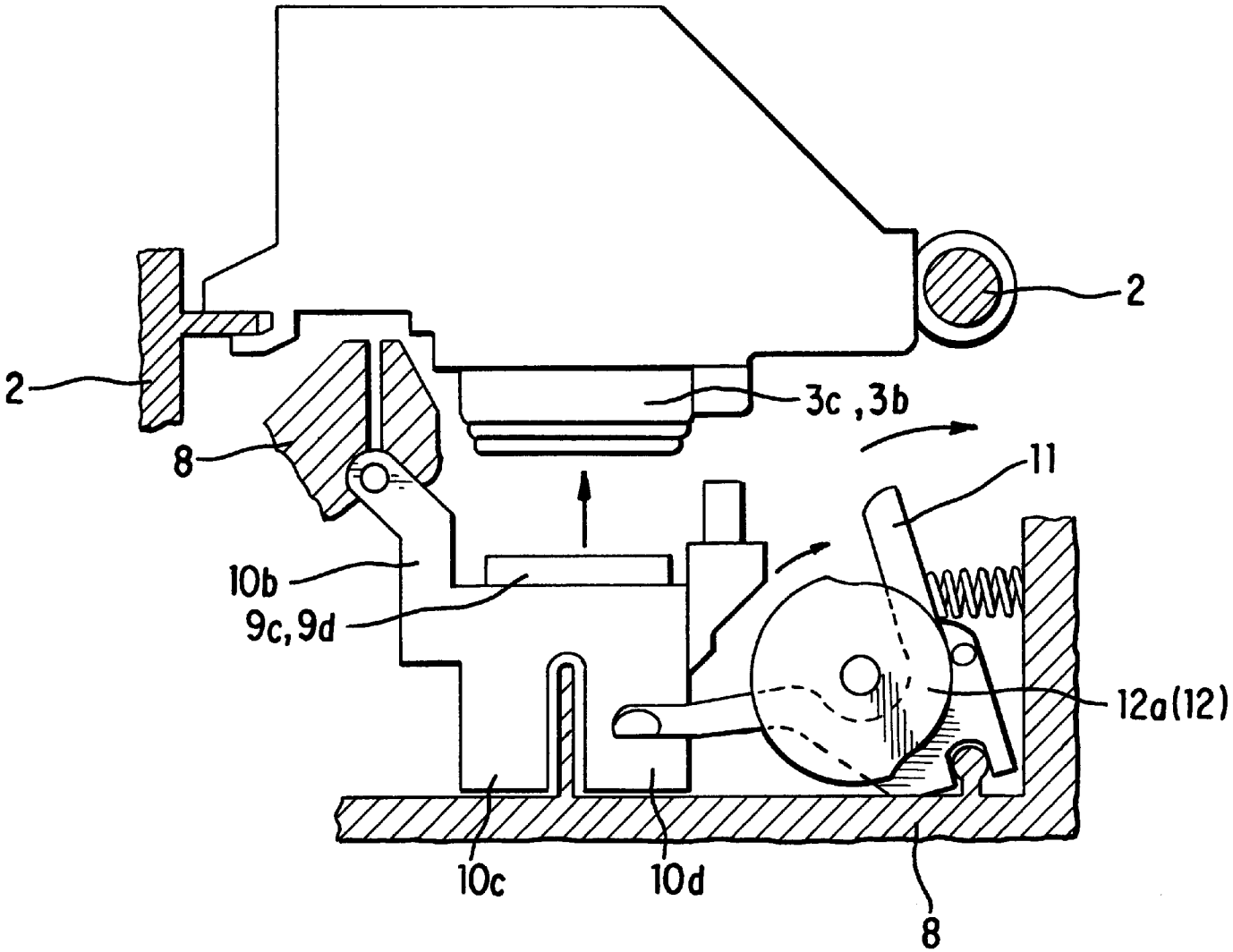
FIG. 6 is a side view of a cap member and a cam drive transfer member.

The cap carriage 10 has a supporting bottom plate 10*a* that supports the two cap member assemblies 9*d* and 9*e*, a pair of arm structures 10*b* arranged at both ends of one side of the cap carriage 10, a guide member 10*c* disposed under the supporting bottom plate 10*a*, and a supporting member 10*d* disposed under the supporting bottom plate 10*a* and adjacent the guide member 10*c*. As shown in FIG. 6, when the arm structures 10*b* and guide member 10*c* are joined to the unit housing 8, the supporting member 10*d* is connected to an L-shaped arm 11, and the L-shaped arm 11 is able to move up and down (while maintaining its orientation) by being moved by a cam 12*a*. Hereafter, a member forming the cam 12*a* is called a cam drive transfer member 12.

Moreover, the cap carriage 10, as indicated in FIGS. 7A–7D, is arranged so as to be movable in a same direction as the direction of movement of the recording head carriage 3, which is hereafter referred to as a left/right direction. A force is applied in a right side direction of the cap carriage 10 by a spring 13.

Figure 8:
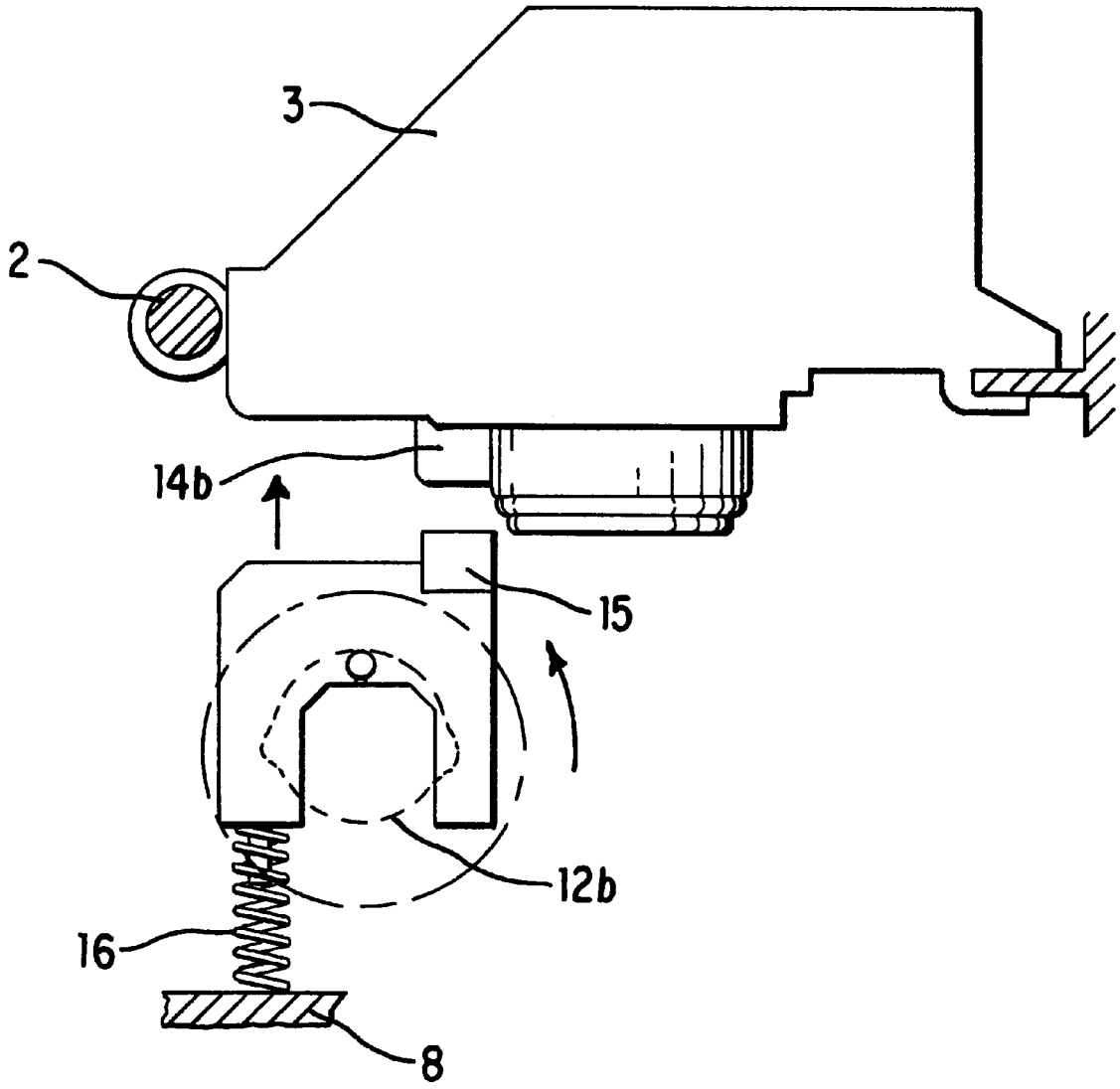
FIG. 8 is a side view of the cap carriage engaging member and the carriage position fixing member of FIGS. 7A–7D illustrating a locking operation.

Moreover, on the recording head carriage 3 are formed two projections 14*a* and 14*b* that are positioned next to the two nozzle members 3*b* and 3*c*. An engagement pin 14*c* is arranged on the cap carriage 10 in a position that corresponds to a path of motion of the two projections 14*a* and 14*b*. A fixing pin 15 is arranged near the engagement pin 14*c* so that it is movable in an up-and-down direction in the station main body 4*a*. The fixing pin 15, as indicated in FIG. 8, is biased upwards by a second spring 16 that is inserted between the unit housing 8 and the fixing pin 15. The fixing pin 15 also engages a channel 12*b* of a gear 12*g* of the cam drive transferring member 12, thereby setting the height of the fixing pin 15.

Figure 7A:
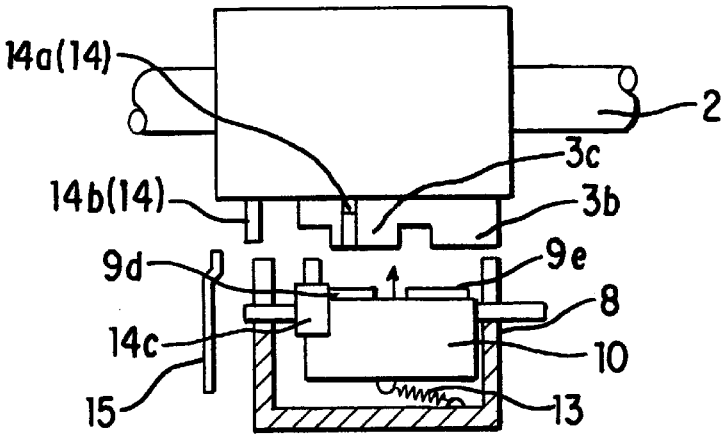
FIGS. 7A–7D are side views of a cap carriage engaging member and a carriage position fixing member illustrating a capping operation.
Figure 7B:
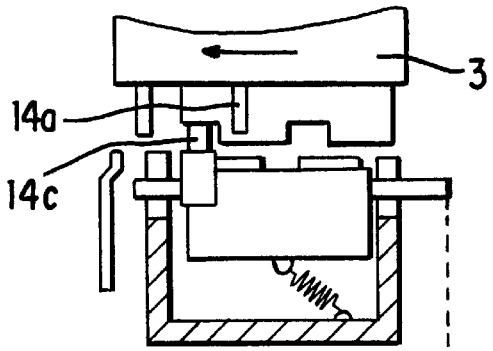
Figure 7C:
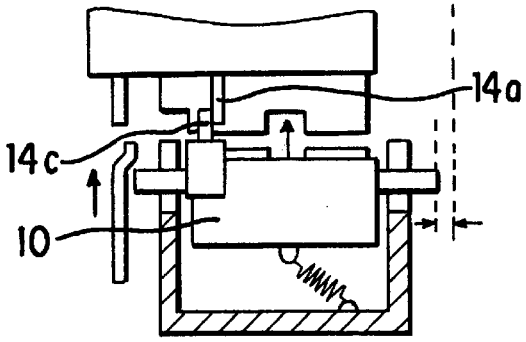
Figure 7D:
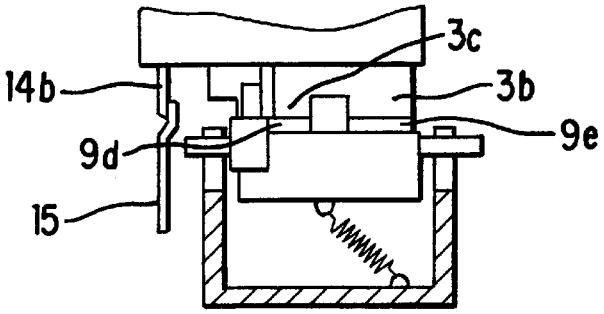

Then, the station main body raises the cap carriage 10 to a height at which the engagement pin 14*c* and the projection 14*a* can engage as best shown in FIG. 7B. The engagement pin 14*c* and the projection 14*a* are then engaged by moving the recording head carriage 3 to the left side, and the cap carriage 10 is moved slightly to the left side as shown in FIG. 7C. Assured capping is possible when the cap carriage 10 is raised and the cap member assemblies 9*d* and 9*e* are pressed against the nozzle members 3*b* and 3*c* as shown in FIG. 7D. At the station main body 4*a*, when the cap members 9*d* and 9*e* are pressed against the nozzle members 3*b* and 3*c*, the fixing pin 15 and the engagement pin 14*c* can be inserted between the two projections 14*a* and 14*b* and the recording head carriage 3 can be fixed by raising the fixed pin 15 to engage the projection 14*b*.

Further, in FIGS. 5 and 6, a pump 17*a* with two hoses 17*b* is connected to each cap member assembly 9*d* and 9*e*. These elements form a pump assembly 17. The ink in each cap member assembly 9*d* and 9*e* can be sucked by the single pump 17*a*. Moreover, a waste ink conductor 18 is connected to an exhaust port 23 (shown in FIG. 11) of the pump 17*a*, and is structured so that ink is expelled to the waste ink absorptive main body 4*b* from the waste ink conductor 18.

Figure 10A:
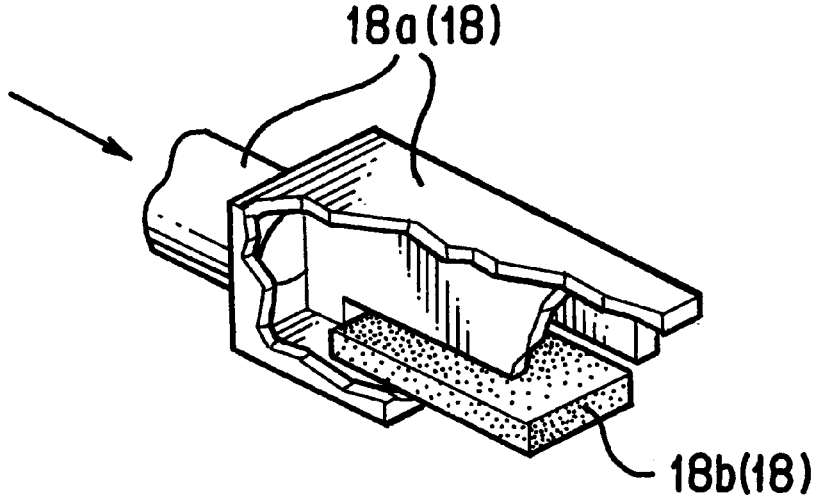
FIG. 10A is a partially broken away perspective view of a waste ink conductor.
Figure 10B:
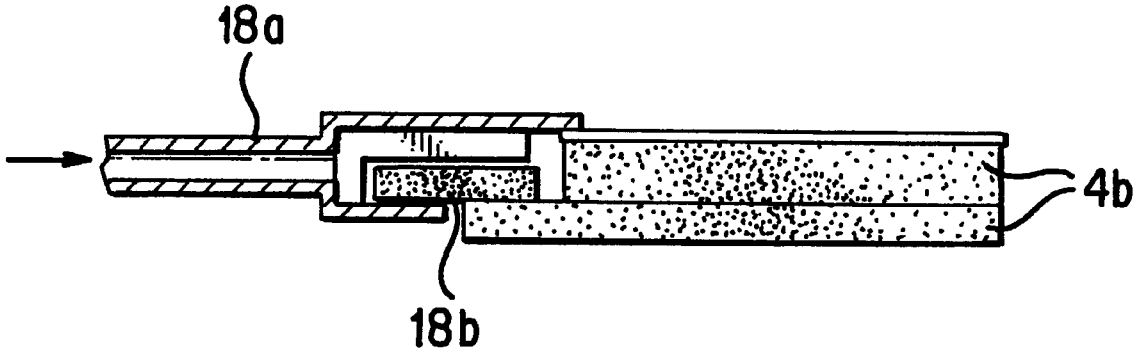
FIG. 10B is a cross-sectional side view of the waste ink conductor of FIG. 10A.

Since the pump 17*a* and the waste ink absorbing main body 4*b* are arranged in approximately horizontal positions, as indicated in FIG. 10B, a sponge 18*b* is arranged at an exhaust port of the waste ink conductor 18 in order to avoid dripping of waste ink when the ink absorptive main body 4*b* is exchanged.

Figure 11:
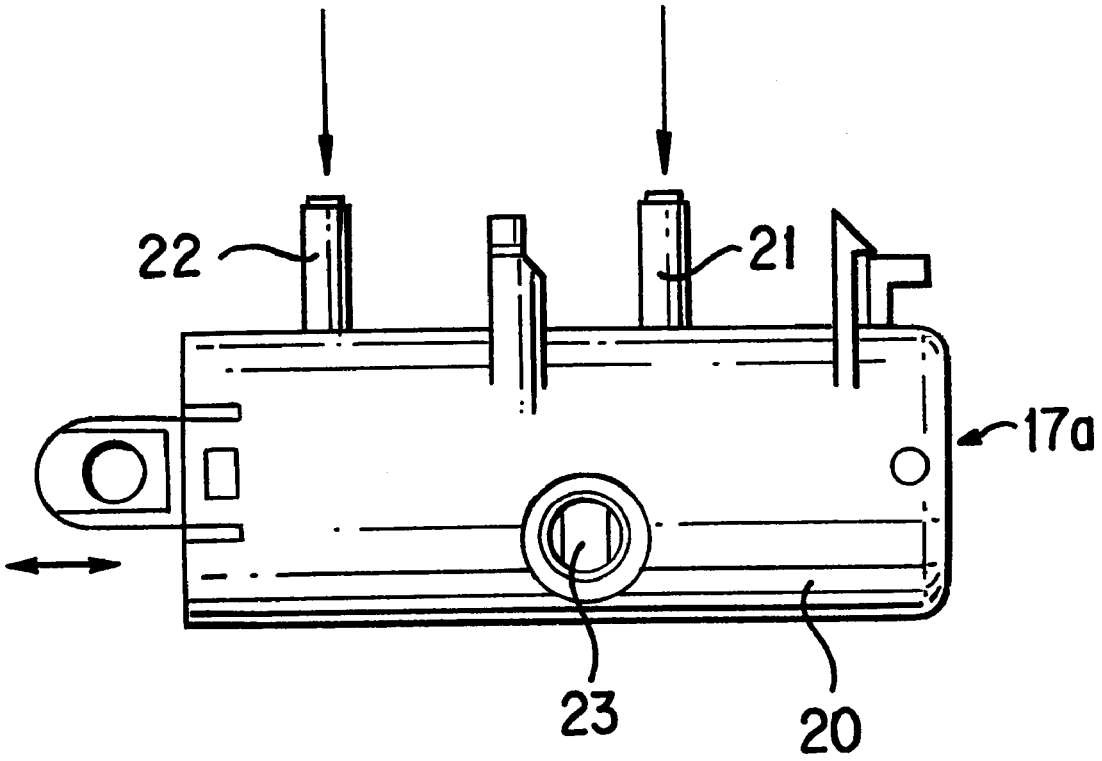
FIG. 11 is a front, elevation view of the pump.
Figure 12:
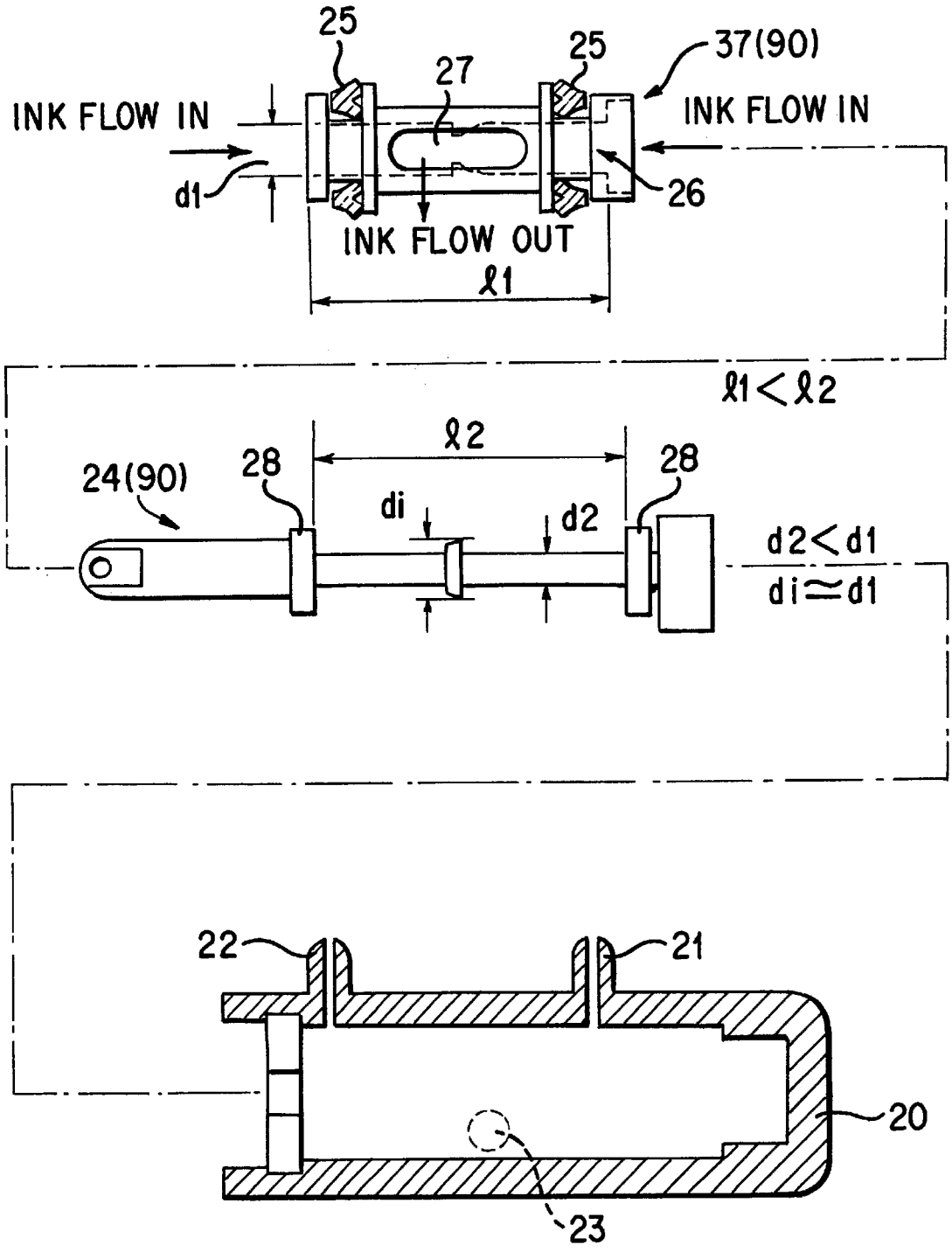
FIG. 12 is an exploded side view of the pump.
Figure 13A:
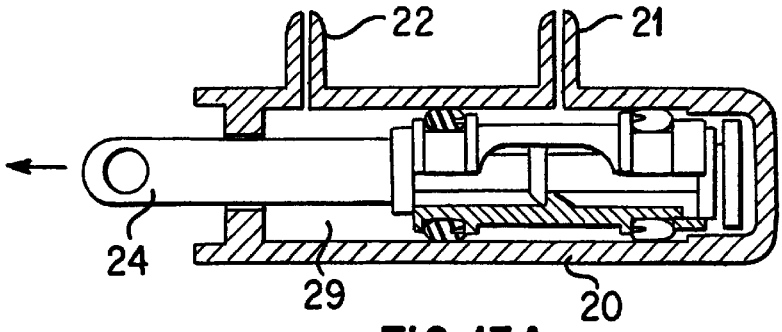
FIGS. 13A–13D are cross-sectional side views of the pump at various pump positions.
Figure 13B:
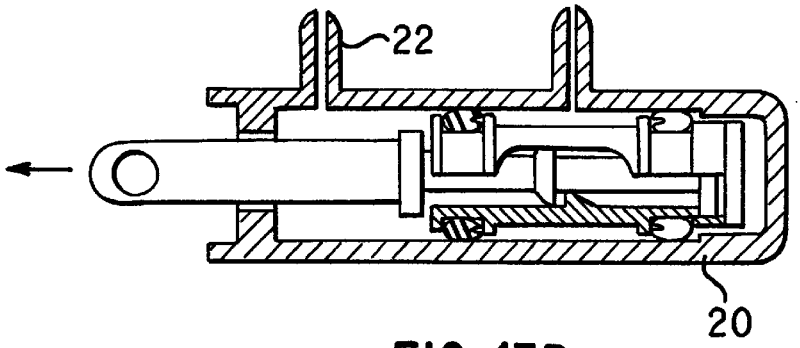
Figure 13C:
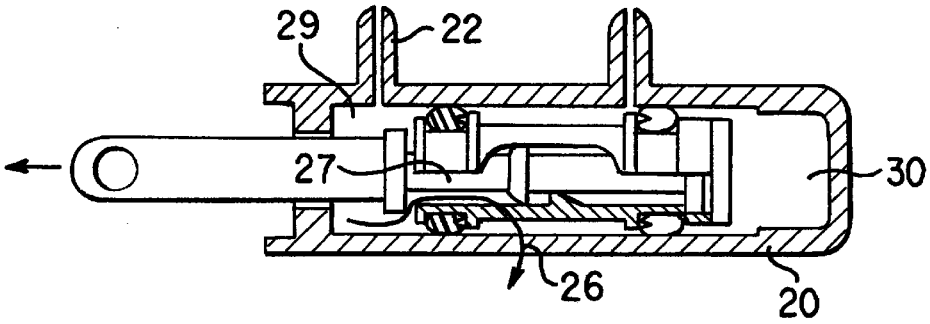
Figure 13D:
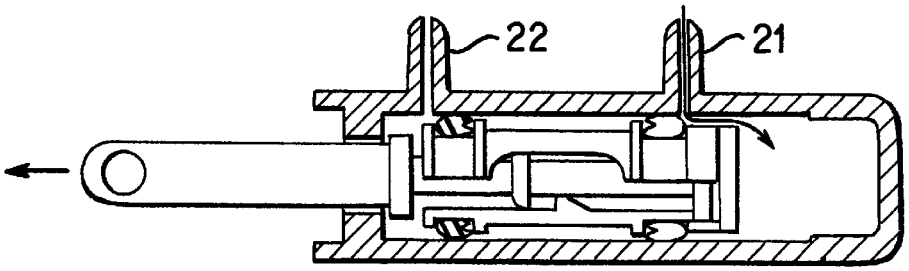

As shown in FIG. 11, the pump has two ink absorbing ports 21 and 22 formed in an upper portion of a cylinder 20. The ink exhaust port 23 is formed in a bottom center part of the cylinder 20 in order to make the ink expel easier. Hereafter, the ink absorbing port 21 that is connected to the right side cap member assembly 9*e* is called the right side ink suction port, while the ink suction port 22 that is connected to the left side cap member assembly 9*d* is called the left side ink suction port. Moreover, as indicated in FIG. 12, the cylinder 20 receives a piston 90 that is a same size as an inner circumferential surface of the cylinder 20. The piston comprises a piston head 37 that has a through-hole 26 formed in the center portion thereof and a piston rod 24 that is formed with a diameter d2 that is smaller than the diameter of the through-hole 26.

Specifically, the piston head 37 comprises a pair of rubber piston rings 25, one at each end of the piston head and positioned around the circumference thereof and an ink drain port 27 formed in a side of the piston head 37 between the piston rings 25 and in communication with the through-hole 26.

The piston rod 24 has a pair of through-hole sealing plates 28 that are sized to seal the through-hole 26 of the piston head 37. The through-hole sealing plates 28 are arranged and installed at a spacing $l_2$ that is slightly longer than the length $l_1$ of the through-hole 26 of the piston head 37. Moreover, the piston rod 24 is connected to the cam of the cam drive transferring member 12 through a drive transfer arm 19 shown in FIG. 9.

Figure 14A:
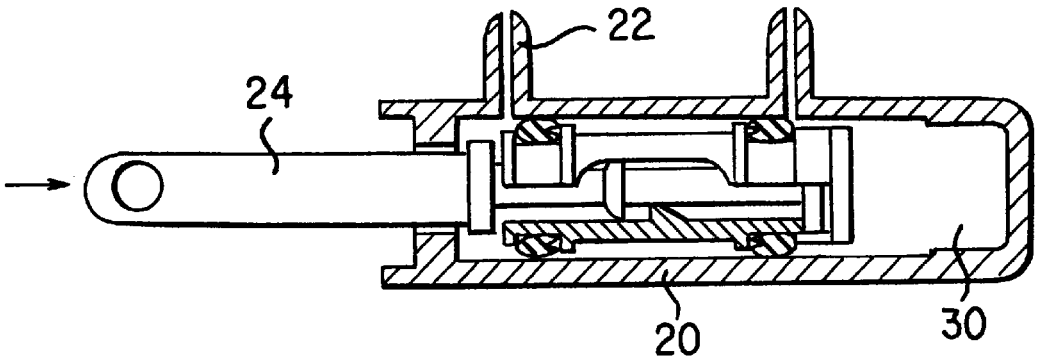
FIGS. 14A–14C are cross-sectional side views of the pump at various pump positions.
Figure 14B:
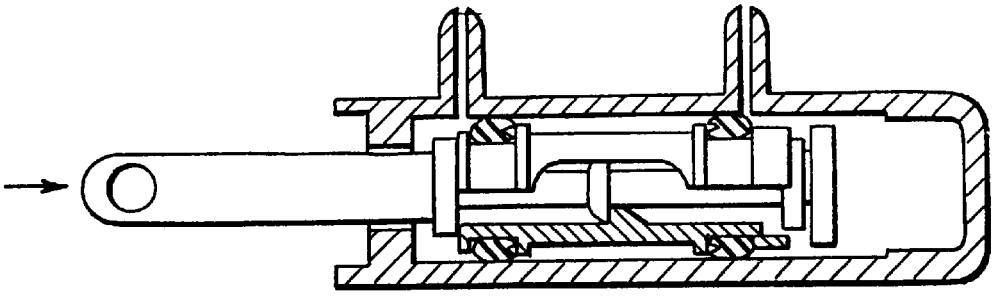
Figure 14C:
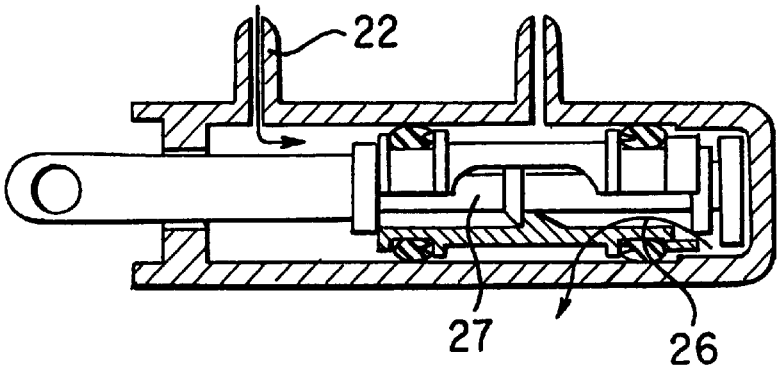

The pump 17*a*, as shown in FIGS. 13A–13D, sucks in ink from the right side ink suction port 21, and also expels ink held in a left side chamber 29 of the cylinder 20 through the through-hole 26 and the ink exhaust port 23 (shown in FIG. 9) via the ink drain port 27. Moreover, as indicated in FIGS. 14A–14C, the pump sucks ink away from the left side ink suction port 22 as the piston rod 24 is pushed back, and the waste ink which was kept in the right side chamber 30 of the cylinder 20 is expelled from the ink exhaust port 23 (FIG. 9) via the through-hole 26 and the ink drain port 27.

Figure 15:
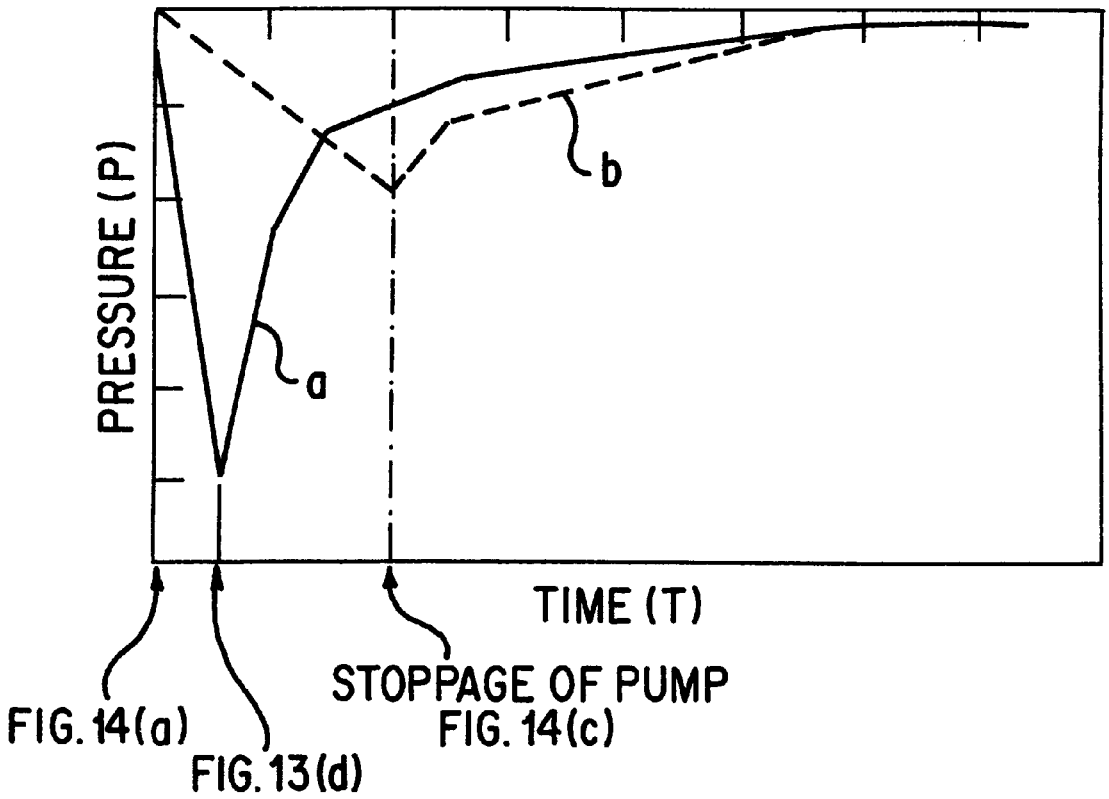
FIG. 15 is a chart reflecting a suction pressure of the pump as a function of time.

Moreover, in this embodiment, extremely high pressure can be applied instantly as indicated by the line "a" of FIG. 15 since the right side ink suction port 21 is formed near a center of the cylinder 20 and is arranged so as to communicate with the right side chamber 30 in the cylinder 20 when the piston head 37 is moved to some extent. On the other hand, the left side ink suction port 22 is arranged near an edge of the cylinder 20 and is arranged so as to communicate constantly with the inside of the cylinder 20 so that the low pressure shown by line "b" in FIG. 15 acts for a relatively long period of time.

Figure 16A:
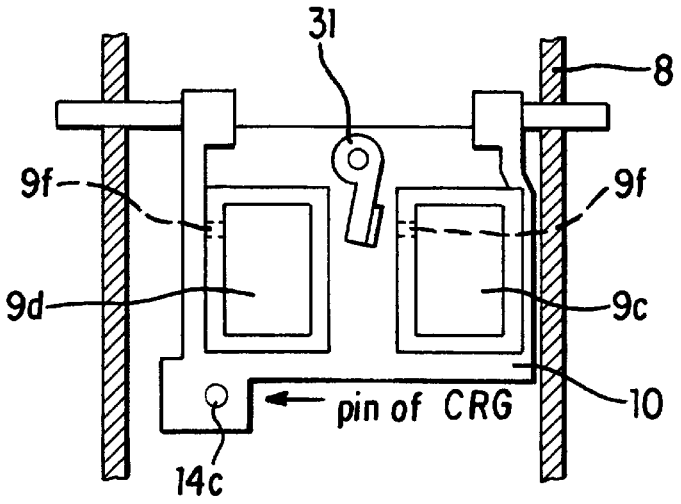
FIGS. 16A–16C are side views of a cap member having a through-hole and disposed in a sequence of cap positions.
Figure 16B:
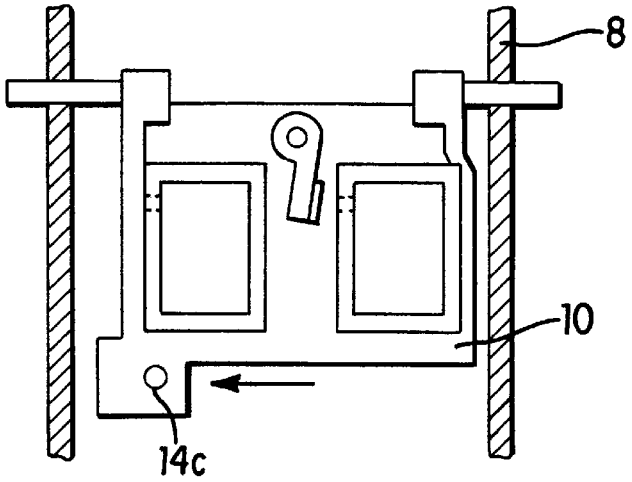
Figure 16C:
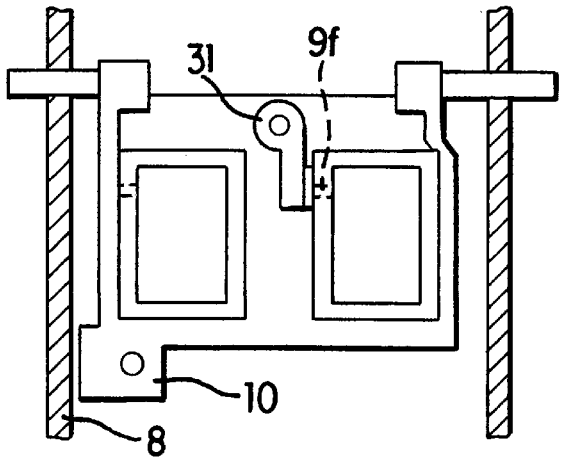

Next, in FIG. 5, a sealing valve 31 seals the through-hole 9*f* of the right side cap member assembly 9*e*, and is arranged on the cap carriage 10. Further, the sealing valve 31, as indicated in FIGS. 16A–16C, is structured such that the cap carriage 10 is pushed by the recording head carriage 3 and seals the through-hole 9*f* by moving to the left side. There is a stopper (not indicated in the figure) which restricts the rotation of the sealing valve 31, and this maintains the stopped condition even when the sealing valve 31 and the cap carriage 10 are moved. The sealing valve 31 seals the through-hole 9*f* by unlocking the restriction of the stopper of the sealing valve 31.

Figure 17A:
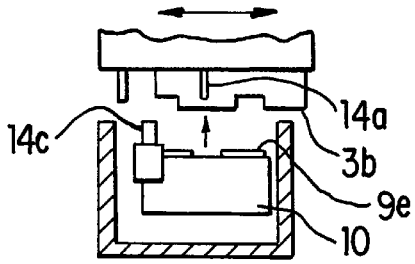
FIGS. 17A–17E are partial cross-sectional side views of a right side nozzle disposed in a sequence of right side nozzle positions.
Figure 17B:
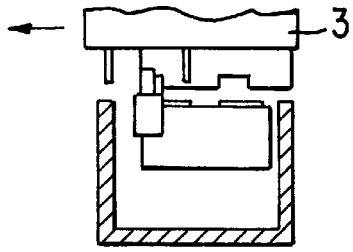
Figure 17C:
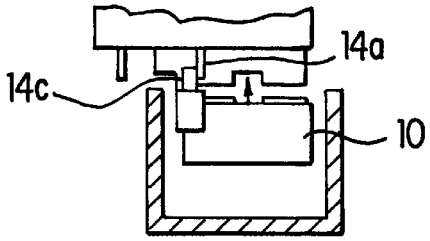
Figure 17D:
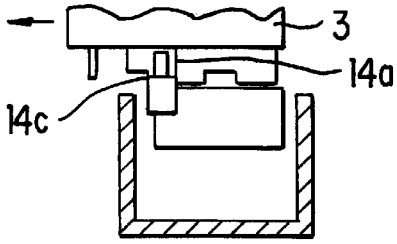
Figure 17E:
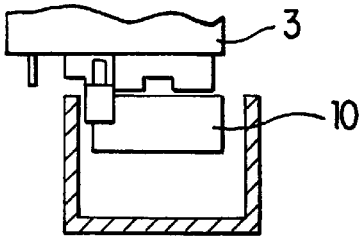

As shown in FIGS. 17A–17E, the station main body 4*a* causes the projection 14*a* on the right side to engage with the engagement pin 14*c* and covers the black ink nozzle member 3*b* with the right side cap member assembly 9*e*. Also, the station main body 4*a* moves the recording head carriage 3 to the left side and seals the through-hole 9*f* of the cap member 9*e* on the right side with the seal valve 31 as shown in FIGS. 17A and 16C. By operating the pump 17*a* in this state, it is possible to suck foreign material such as ink that has increased in viscosity within the black ink nozzle member 3*c*.

Figure 18A:
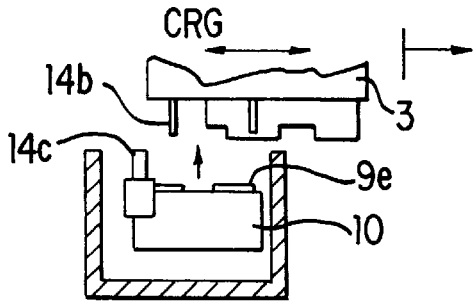
FIGS. 18A–18E are partial cross-sectional views of a left side nozzle disposed in a sequence of left side nozzle positions.
Figure 18B:
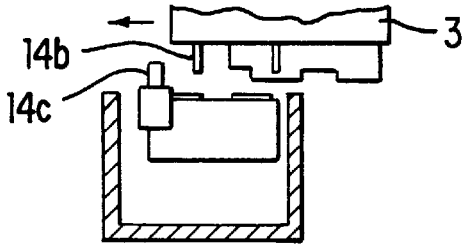
Figure 18C:
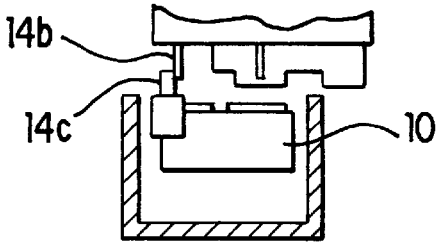
Figure 18D:
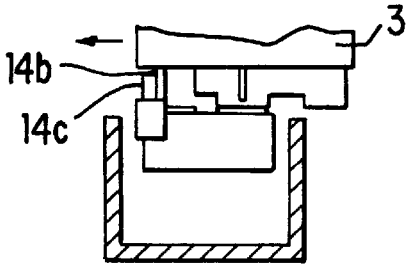
Figure 18E:
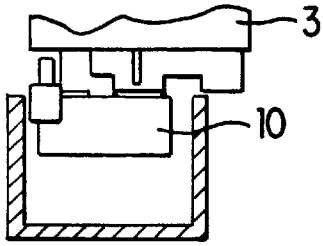

Moreover, as shown in FIGS. 18A–18E, the station main body 4*a* causes the projection 14*b* on the left side to engage with the engagement pin 14*c*, and covers the color nozzle 3*c* by the cap member assembly 9*e*, which is disposed on the right side. The recording head carriage 3 is moved to the left side and seals the through-hole 9*f* of the cap member 9*e* on the right side with the seal valve 31 as shown in FIG. 18E. By operating the pump 17*a* in this state, it is possible to suck foreign material such as ink that has increased in viscosity within the color nozzle member 3*c*.

Furthermore, the station main body 4*a* positions the recording head carriage 3 so that each of the nozzle members 3*b* and 3*c* face the respective cap member assemblies 9*d* and 9*e* as shown in FIG. 17A. Ink is ejected from nozzle members 3*b* and 3*c* and received at each cap member assembly 9*a* and 9*e*, and the ink is sucked away as the pump 17*a* is operated with the carriage in this state.

Moreover, as shown in FIG. 5, a wiper 32 has a rubber blade. A force is applied by a third spring 33 provided between the station main body 4*a* and the wiper 32. The height of the wiper 32 can be set by pushing down on the wiper 32 through the cam drive transfer member 12. Also, in FIG. 19B, ink absorption bodies 3*j* and 3*k* are made from sponges.

Figure 19A:
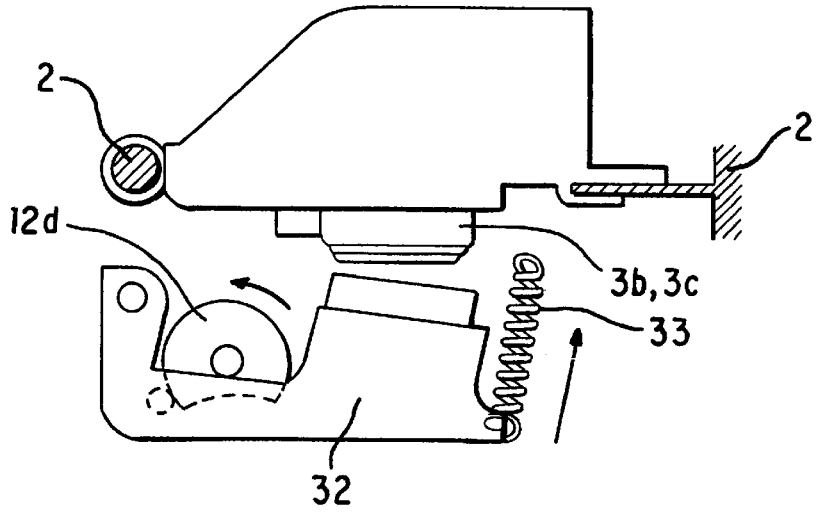
FIG. 19A is a side elevational view of a wiper member.
Figure 19B:
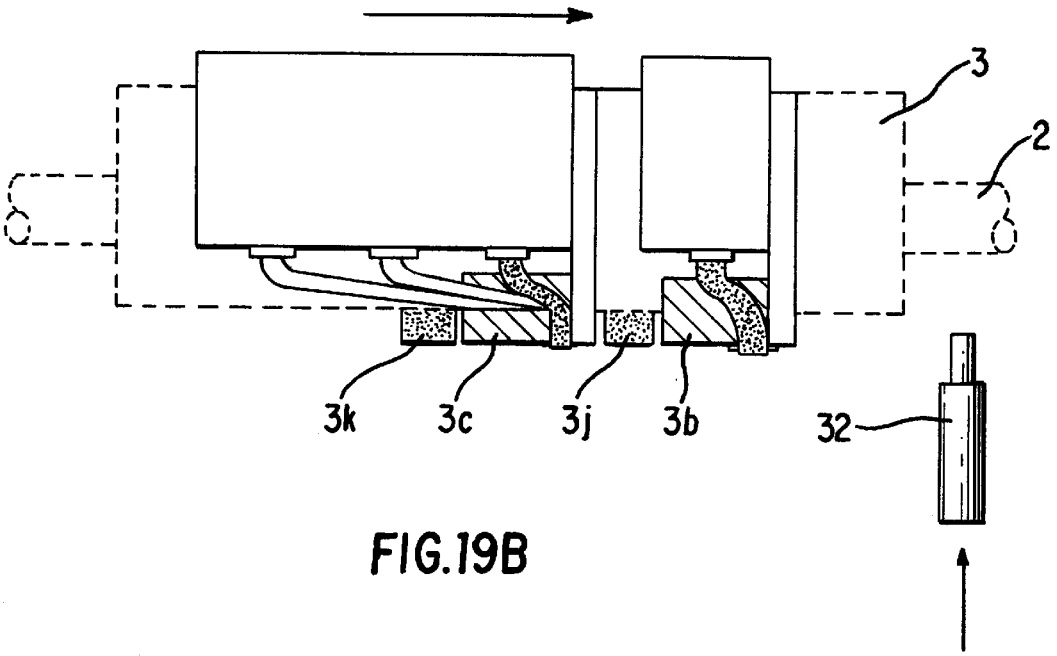
FIG. 19B is a top plan view of the wiper member in FIG. 19A.

Further, as shown FIGS. 19A and 19B, the station main body 4*a* is moved such that a blade edge of the wiper 32 is positioned in the path of movement of the nozzle members 3*b* and 3*c*, and the recording head carriage 3 is moved from the home position to the right side. Thus, the blade edge can contact an edge of each nozzle member 3*b* and 3*c*. Moreover, after contacting the edge of each nozzle member, the blade edge is cleaned by the ink absorbing bodies 3*j* and 3*k* so that the black ink does not mix with the color ink.

Finally, FIG. 5 illustrates a pulse motor 34, the cam drive transfer member 12, a gear train 35 that transfers the rotation of the pulse motor 34 to the cam drive transfer member 12, and a sensor 36 that detects the rotating phase of the cam drive transfer member 12 via cam member 12*h*. The drive means includes these elements.

Figure 21:
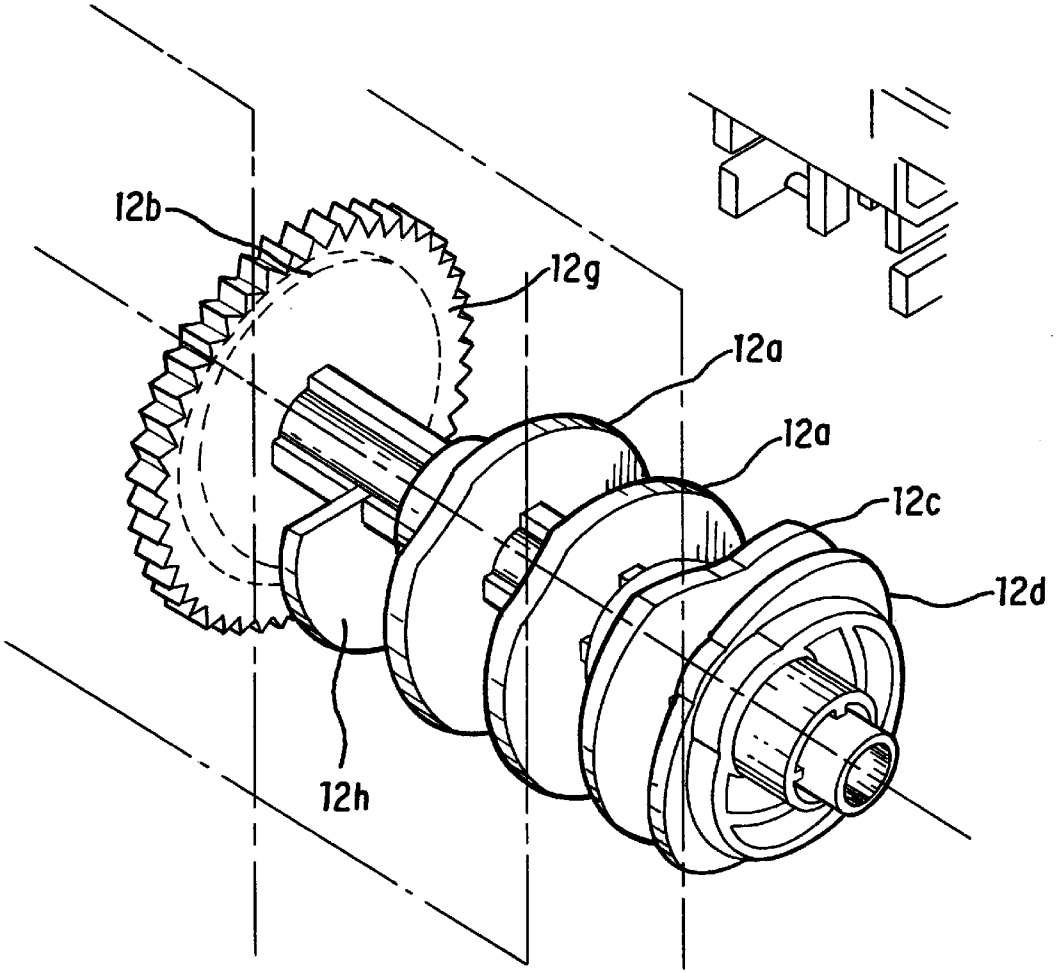
FIG. 21 is a perspective view of a cam drive transfer member.

As shown in FIG. 21, the cam drive transfer member 12, as described above, comprises the cam 12*a* for capping that moves the cap member assemblies 9*d*, 9*e* and the like vertically, a channel 12*b* in a gear 12*g* that moves the fixing pin 15 vertically, a pumping cam 12*d* that drives the pump 17*a*, a wiping cam 12*c* that moves the wiper 32 vertically, and a cam member 12*h* for the sensor 36.

Figure 20:
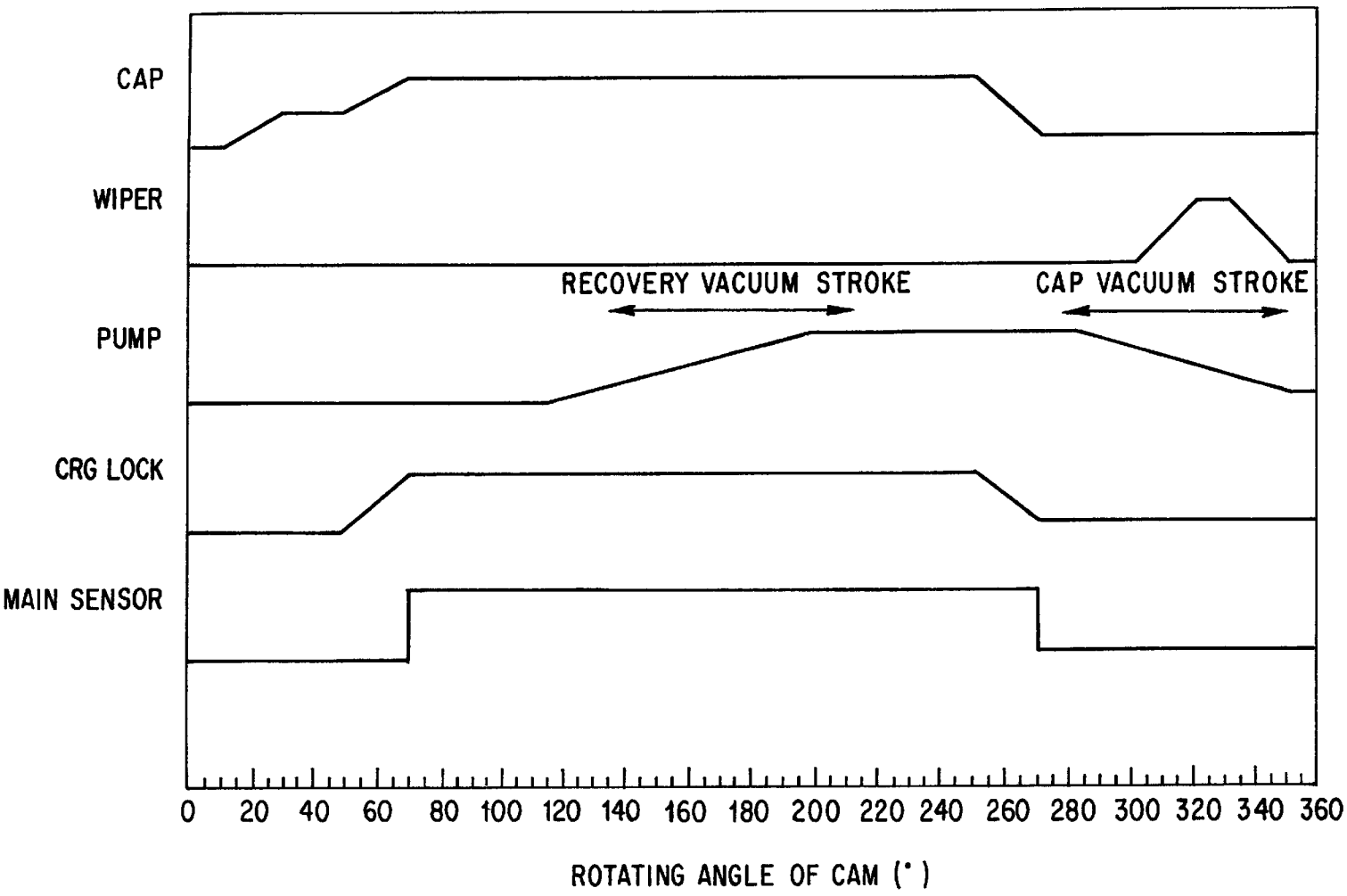
FIG. 20 is a chart illustrating respective conditions of the cap member, the wiper member, the pump, a CRG lock and a main sensor as a function of a cam angle.

Also, the cams are formed so as to drive each respective member against a fixed rotating phase of the cam drive transfer member 12 as shown in FIG. 20. To describe FIG. 20 more specifically, an image forming mode is allotted in which all of the members 9*c*, 9*d*, 14*c*, 15 and 32 are in a retreated position in a rotating range of 350°–10° of the cam, a cap position-determining mode is allotted in which the cap carriage 10 is raised to a half position when in a rotating range of 30°–50°, a carriage stopping mode is allotted in which cap members such as 9*c*, 9*d*, 14*c* and the fixing pin 15 are raised when in a rotating range of 70°–120°, a vacuum mode is allotted in which the pump 17*a* is driven in a condition in which cap members such as 9*c*, 9*d*, 14*c* and the fixed pin 15 are raised when in a rotating range of 120°–200°, a cap interior space vacuum mode is allotted in which a pump 17*a* is driven in the condition in which the cap members such as 9*c*, 9*d*, 14*c* and the fixed pin 15 are retreated when in a rotating range of 280°–350°; and, a wiping mode is allotted in which the wiping member 32 is raised when in a rotating range of 320°–330°. The cap interior space vacuum mode is used for sucking the ink discharged from the dummy jet.

Then, in this embodiment, when an image is not being formed, not only is the recording head carriage 3 set in the home position, but it is also set in a carriage stopping mode. Also, when image forming begins, it is set so that it enters into the image forming mode after executing the dummy jet and wiping mode. After image forming has been completed, it is further set so that it goes to the carriage stopping mode after executing the cap position-determining mode. Moreover, experiments were conducted in which, based on a command by the user, it was set so as to execute the vacuum mode.

As a result, in the ink-jet type image forming apparatus, there is no clogging of nozzle members 3*b* and 3*c* when they are used for a long period of time and there is no failure of image forming. Also, even if clogging of the nozzle members 3*b* and 3*c* were to occur after this period of time, it would be possible to recover immediately.

Moreover, in the ink-jet type image forming apparatus of this invention, with the one pulse motor, it is possible to position-determine the cap members 9*c* and 9*d*, the wiper member 32, the carriage position fixing member 15 and the cap through-hole sealing member 31 so that they advance with respect to the path of motion of the recording head carriage. Also, since the pump 17*a* is operated, there is no need to install a drive means individually for each member, thus making it possible to greatly reduce the size of the apparatus.

As described above, in the ink-jet method of image forming apparatus of the present invention, because the cap members, the wiper member, the carriage position fixing member and the cap through-hole sealing member are position-determined so that they advance with respect to the path of motion of the recording head carriage, and because the drive means has been provided to operate the pump, there is no need to install a drive means for each individual member. Thus, it is possible to effectively reduce the size of the apparatus, in conjunction with solving each type of problem described above.

What is claimed is:

1. An ink-jet type image forming apparatus, comprising:

a recording medium transfer member for transferring a recording medium in a transfer direction defining a transfer path;

a recording head carriage that is disposed opposite the transfer path of the recording medium and is movable in a direction that intersects the transfer direction of the recording medium, and that ejects ink from a nozzle member towards the transfer path of the recording medium and forms an image on the recording medium by ejecting ink corresponding to image information, while the recording medium is transferred by the recording medium transfer member and the recording head carriage is operated in a back-and-forth motion in the recording direction;

a cap member that is arranged so as to be movable while facing the path of motion of said nozzle member and covers the nozzle member;

a wiper member that is movable while facing the path of motion of said nozzle member and removes ink which is adhered to the tip of the nozzle member;

a carriage position fixing member disposed opposite to said recording head carriage moving path, which is engageable with said carriage; and a single drive source coupled to said cap member and to said wiper member to drive said cap member and said wiper member between a first position where the cap member and the wiper member contact the nozzle member and a second position where the cap member and the wiper member are disposed apart from the nozzle member, said single drive source also coupled to and moving said carriage position fixing member with a back-and-forth motion in a vertical direction which is substantially perpendicular to the transfer direction and the recording direction to selectively place said carriage position fixing member in a path of said recording head carriage.

2. The ink-jet type image forming apparatus of claim 1, further comprising a back-and-forth motion type pump member connected to said cap member that evacuates an inside of the cap member, and wherein said single drive source is coupled to and operates said pump member.

3. The ink-jet type image forming apparatus of claim 2, wherein the single drive source comprises a drive motor having rotational capability and a cam drive transmitting member that transmits the rotation of the drive motor to each member, said drive motor is stopped at a certain angle of rotation during position-determining, and said motor is continuously rotated in a first direction within a range of a selected angular rotation during operation of the pump.

4. The ink-jet type image forming apparatus of claim 1, further comprising a drive shaft that transmits a drive force from the single drive source, a cap member cam for moving the cap member and attached to the drive shaft, and a wiper member cam for moving the wiper member and attached to the drive shaft.

5. The ink-jet type image forming apparatus of claim 4, further comprising a cam for operating a pump member and attached to the drive shaft.

6. The ink-jet type image forming apparatus of claim 4, further comprising a cam for moving said carriage position fixing member and attached to the drive shaft.

7. The ink-jet type image forming apparatus of claim 1, further comprising a cap carriage that holds the cap member and is arranged opposite the path of motion of the recording head carriage, as well as being arranged facing the recording head carriage and movable in the recording direction; and engaging members provided respectively on the cap carriage and on the recording head carriage so as to mutually engage each other, wherein when said single drive source moves the cap carriage to a position so that said engaging members can be mutually engaged, and the recording head carriage moves said cap carriage in the same direction as the moving direction of the recording head carriage to a predetermined position, the nozzle member is covered by the single drive source moving said cap carriage so that said cap member covers the nozzle member.

8. The ink-jet type image forming apparatus of claim 7, wherein said cap has a through-hole through which outside air passes when the cap covers the nozzle member, and wherein a cap through-hole blocking member is arranged on the cap carriage, and the cap through-hole blocking member blocks the through-hole as the cap carriage is moved by the recording head carriage in the recording direction.

9. The ink-jet type image forming apparatus of claim 8, wherein the cap member is arranged to selectively engage the cap through-hole blocking member and the cap member is arranged to be selectively displaced away from the cap through-hole blocking member, wherein suction of each nozzle member is performed by a pump member when the cap member is engaged with said cap through-hole blocking member.

10. An ink-jet type image forming apparatus, comprising:

a recording medium drive member that drives a recording medium in a transfer direction defining a transfer path;

a recording head carriage that opposes the transfer path of the recording medium and is movable in a direction that intersects the transfer direction of the recording medium, and that ejects ink from a nozzle member towards the transfer path of the recording medium to form an image on the recording medium by ejecting ink corresponding to image information while the recording medium is transferred by the recording medium drive member and the recording head carriage is operated in a back-and-forth motion in the recording direction;

a cap member that is movable while facing the path of motion of said nozzle member to selectively cover the nozzle member;

a cap carriage that holds the cap member and that is arranged opposite the path of motion of the recording head carriage, the cap carriage also facing the recording head carriage and being movable in the recording direction;

a first engaging member provided on the cap carriage and a second engaging member provided on the recording head carriage, said first and second engaging members being engageable with each other; and drive means for moving said cap member between a first position where the cap member contacts the nozzle member and a second position where the cap member is disposed apart from the nozzle member, wherein when it is desired to cap the nozzle member with the cap member, said drive means first moves the cap carriage to a position where said first and second engaging members can mutually engage each other, then the recording head carriage moves said cap carriage in the same direction as the moving direction of the recording head carriage to a predetermined position, and then the drive means moves the cap carriage towards the nozzle member so that said cap member covers the nozzle member.

11. The ink-jet type image forming apparatus of claim 10, further comprising:

a wiper member that is movable while facing the path of motion of said nozzle member to remove ink which is adhered to the tip of the nozzle member by wiping the nozzle member; and wherein said drive means also moves said wiper member between the first position where the wiper member contacts the nozzle member and the second position where the wiper member is disposed apart from the nozzle member.

12. The ink-jet type image forming apparatus of claim 10, wherein said cap member has a through-hole through which outside air passes when the cap member covers the nozzle member, and wherein a cap through-hole blocking member is arranged on the cap carriage, and the cap through-hole blocking member blocks the through-hole as the cap carriage is moved by the recording head carriage in the recording direction.

13. The ink-jet type image forming apparatus of claim 12, wherein the cap member is arranged to selectively engage the cap through-hole blocking member and the cap member is arranged to be selectively displaced away from the cap through-hole blocking member, wherein suction of each nozzle member is performed by a pump member when the cap member is engaged with said cap through-hole blocking member.

14. An ink-jet type image forming apparatus, comprising:

a recording medium drive member that drives a recording medium in a transfer direction defining a transfer path;

a recording head carriage that opposes the transfer path of the recording medium and is movable in a direction that intersects the transfer direction of the recording medium, and that ejects ink from a nozzle member towards the transfer path of the recording medium to form an image on the recording medium by ejecting ink corresponding to image information while the recording medium is transferred by the recording medium drive member and the recording head carriage is operated in a back-and-forth motion in the recording direction;

a cap member that is movable while facing the path of motion of said nozzle member to selectively cover the nozzle member;

a wiper member that is movable while facing the path of motion of said nozzle member to selectively remove ink which is adhered to the tip of the nozzle member by wiping the nozzle member; and a drive system including: a drive source, a drive shaft coupled to the drive source to transmit a drive force from the drive source, a cap member cam for moving the cap member and attached to the drive shaft, a wiper member cam for moving the wiper member and attached to the drive shaft, and a cam for moving a carriage position fixing member and attached to the drive shaft, wherein the drive source drives said cap member and said wiper member between a first position where the cap member and the wiper member contact the nozzle member and a second position where the cap member and the wiper member are disposed apart from the nozzle member.

15. The ink-jet type image forming apparatus of claim 14, further comprising:

a carriage position fixing member disposed opposite to said recording head carriage moving path, which is engageable with said carriage, wherein said drive source is coupled to said carriage position fixing member by said cam and moves said carriage position fixing member with a back-and-forth motion in a vertical direction which is substantially perpendicular to the transfer direction and the recording direction to selectively place said carriage position fixing member in a path of said recording head carriage.

16. The ink-jet type image forming apparatus of claim 14, further comprising:

a pump cam for operating the pump member and attached to the drive shaft, and wherein said drive source operates said pump member.

* * * * *